US009868501B1

(12) United States Patent
Gable et al.

(10) Patent No.: US 9,868,501 B1
(45) Date of Patent: Jan. 16, 2018

(54) METHOD AND SYSTEM FOR CONTROLLING PROPULSION OF A MARINE VESSEL

(71) Applicant: Brunswick Corporation, Lake Forest, IL (US)

(72) Inventors: Kenneth G. Gable, Oshkosh, WI (US); Jason F. Pugh, Ripon, WI (US); Thomas S. Kirchhoff, Fond du Lac, WI (US); Andrew J. Przybyl, Berlin, WI (US)

(73) Assignee: Brunswick Corporation, Mettawa, IL (US)

( * ) Notice: Subject to any disclaimer, the term of this patent is extended or adjusted under 35 U.S.C. 154(b) by 57 days.

(21) Appl. No.: 15/182,662

(22) Filed: Jun. 15, 2016

(51) Int. Cl.

| | |
|---|---|
| ***G05D 1/00*** | (2006.01) |
| ***G05D 3/00*** | (2006.01) |
| ***G06F 7/00*** | (2006.01) |
| ***G06F 17/00*** | (2006.01) |
| ***B63H 21/21*** | (2006.01) |
| ***B63H 20/00*** | (2006.01) |

(52) U.S. Cl.
CPC ..... *B63H 21/21* (2013.01); *B63H 20/00* (2013.01); *B63H 21/213* (2013.01); *B63H 2020/003* (2013.01); *B63H 2021/216* (2013.01)

(58) Field of Classification Search
CPC ..... B63H 21/21; B63H 20/00; B63H 21/213; B63H 2021/216; B63H 2020/003
USPC ..... 701/1, 2
See application file for complete search history.

(56) References Cited

U.S. PATENT DOCUMENTS

| | | | | |
|---|---|---|---|---|
| 6,250,292 | B1 | 6/2001 | Suhre | |
| 6,273,771 | B1 | 8/2001 | Buckley et al. | |
| 6,298,824 | B1 | 10/2001 | Suhre | |
| 6,701,890 | B1 | 3/2004 | Suhre et al. | |
| 7,467,595 | B1 | 12/2008 | Lanyi et al. | |
| 9,103,287 | B1 * | 8/2015 | Arbuckle | F02D 41/22 |
| 2010/0049386 | A1 * | 2/2010 | Bamba | B63H 21/22 701/21 |
| 2010/0060076 | A1 * | 3/2010 | Gemin | B63H 21/20 307/9.1 |

(Continued)

FOREIGN PATENT DOCUMENTS

| | | | | |
|---|---|---|---|---|
| EP | 3050793 | A1 * | 8/2016 | B63H 21/21 |

OTHER PUBLICATIONS

Pending U.S. Appl. No. 14/177,762, filed Feb. 11, 2014, entitled "Systems and Methods for Controlling Movement of Drive Units on a Marine Vessel", Andrasko et al.

*Primary Examiner* — Jaime Figueroa
(74) *Attorney, Agent, or Firm* — Andrus Intellectual Property Law, LLP

(57) ABSTRACT

A method for controlling propulsion of two or more marine drives in a marine vessel includes detecting a fault condition relating to a first marine drive, and determining, at a first control module associated with the first marine drive, a power limit restriction for the first marine drive based on the fault condition. The method further includes communicating the power limit restriction with the first control module on a CAN bus of the marine vessel, and receiving the power limit restriction at a second control module associated with a second marine drive. The power output of the second marine drive is then reduced based on the power limit restriction for the first marine drive.

20 Claims, 5 Drawing Sheets

(56) References Cited

U.S. PATENT DOCUMENTS

| | | | | |
|---|---|---|---|---|
| 2010/0151750 | A1* | 6/2010 | Ito | B63H 20/12 440/1 |
| 2010/0305789 | A1* | 12/2010 | Ito | B63H 21/213 701/21 |
| 2011/0281477 | A1* | 11/2011 | Inoue | F02D 29/02 440/1 |
| 2013/0213344 | A1* | 8/2013 | Stender | B60J 1/2091 123/198 D |
| 2014/0067228 | A1* | 3/2014 | Polkus | F02B 37/013 701/102 |
| 2014/0102104 | A1* | 4/2014 | Read | F01D 15/04 60/718 |
| 2014/0106631 | A1* | 4/2014 | Ito | B63H 21/21 440/1 |
| 2015/0027124 | A1* | 1/2015 | Hartig | B60L 11/08 60/702 |
| 2015/0330319 | A1* | 11/2015 | Nelson | F02D 33/02 123/319 |

* cited by examiner

METHOD AND SYSTEM FOR CONTROLLING PROPULSION OF A MARINE VESSEL

FIELD

The present disclosure relates to methods and systems for controlling propulsion of a marine vessel, and specifically methods and systems for controlling propulsion of a marine vessel involving two or more marine drives when a power limit restriction is placed on one or more marine drives due to a fault condition.

BACKGROUND

The following U.S. patents and patent applications are hereby incorporated herein by reference.

U.S. Pat. No. 6,250,292 discloses that in the event that a throttle position sensor fails, a method is provided which allows a pseudo throttle position sensor value to be calculated as a function of volumetric efficiency, pressure, volume, temperature, and the ideal gas constant. This is accomplished by first determining an air per cylinder value and then calculated the mass air flow into the engine as a function of the air per cylinder (APC) value. The mass air flow is then used, as a ratio of the maximum mass air flow at maximum power at sea level for the engine, to calculate a pseudo throttle position sensor value. That pseudo TPS (BARO) value is then used to select an air/fuel target ratio that allows the control system to calculate the fuel per cycle (FPC) for the engine.

U.S. Pat. No. 6,298,824 discloses a control system for a fuel injected engine provides an engine control unit that receives signals from a throttle lever that is manually manipulated by an operator of a marine vessel. The engine control unit also measures engine speed and various other parameters, such as manifold absolute pressure, temperature, barometric pressure, and throttle position. The engine control unit controls the timing of fuel injectors and the injection system and also controls the position of a throttle plate. No direct connection is provided between a manually manipulated throttle lever and the throttle plate. All operating parameters are either calculated as a function of ambient conditions or determined by selecting parameters from matrices which allow the engine control unit to set the operating parameters as a function of engine speed and torque demand, as represented by the position of the throttle lever.

U.S. Pat. No. 6,701,890 discloses an engine control system calculates air velocity through a throttle body as a function of mass air flow through the throttle body, air density, and the effective area of air flow through the throttle body as a function of throttle plate position. Mass air flow is calculated as a function of the effective area through the throttle body, barometric pressure, manifold pressure, manifold temperature, the ideal gas constant, and the ratio of specific heats for air. By controlling the throttle plate position as a dual function of throttle demand, which is a manual input, and air velocity through the throttle body, certain disadvantages transient behavior of the engine can be avoided.

U.S. Pat. No. 7,467,595 discloses a method for controlling the movement of a marine vessel including rotating one of a pair of marine propulsion devices and controlling the thrust magnitudes of two marine propulsion devices. A joystick is provided to allow the operator of the marine vessel to select port-starboard, forward-reverse, and rotational direction commands that are interpreted by a controller which then changes the angular position of at least one of a pair of marine propulsion devices relative to its steering axis.

U.S. Pat. No. 9,103,287 discloses drive-by-wire control systems and methods for a marine engine that utilize an input device that is manually positionable to provide operator inputs to an engine control unit (ECU) located with the marine engine. The ECU has a main processor that receives the inputs and controls speed of the marine engine based upon the inputs and a watchdog processor that receives the inputs and monitors operations of the main processor based upon the inputs. The operations of the main processor are communicated to the watchdog processor via a communication link. The main processor causes the watchdog processor to sample the inputs from the input device at the same time as the main processor via a sampling link that is separate and distinct from the communication link. The main processor periodically compares samples of the inputs that are simultaneously taken by the main processor and watchdog processor and limits the speed of the engine when the samples differ from each other by more than a predetermined amount.

U.S. patent application Ser. No. 14/177,762, filed Feb. 11, 2014, discloses a system for controlling movement of a plurality of drive units on a marine vessel having a control circuit communicatively connected to each drive unit. When the marine vessel is turning, the control circuit defines one of the drive units as an inner drive unit and another of the drive units as an outer drive unit. The control circuit calculates an inner drive unit steering angle and an outer drive unit steering angle and sends control signals to actuate the inner and outer drive units to the inner and outer drive unit steering angles, respectively, so as to cause each of the inner and outer drive units to incur substantially the same hydrodynamic load while the marine vessel is turning. An absolute value of the outer drive unit steering angle is less than an absolute value of the inner drive unit steering angle.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one embodiment, a method for controlling propulsion of two or more marine drives in a marine vessel includes detecting a fault condition relating to a first marine drive, and determining, at a first control module associated with the first marine drive, a power limit restriction for the first marine drive based on the fault condition. The method further includes communicating the power limit restriction with the first control module on a CAN bus of the marine vessel, and receiving the power limit restriction at a second control module associated with a second marine drive. The power output of the second marine drive is then reduced based on the power limit restriction for the first marine drive.

One embodiment of a system for controlling propulsion of a marine vessel includes a first marine drive having a first engine control module and a first helm control module associated with the first marine drive and communicatively connected to the first engine control module. The system further includes a second marine drive having a second engine control module, and a second helm control module associated with the second marine drive and communicatively connected to the second engine control module. Upon implementation of a power limit restriction on the first marine drive due to a fault condition, the maximum power output of the second marine drive is also limited.

One embodiment of a system for controlling propulsion of a marine vessel includes at least two marine drives, each marine drive having an engine control module, and at least two helm control modules, each helm control module associated with a respective one of the at least two marine drives and its engine control module. The system operates such that upon implementation of a power limit restriction on one of the at least two marine drives due to a detected fault condition, the maximum power output of at least another one of the at least two marine drives is also limited.

Various other features, objects and advantages of the invention will be made apparent from the following description taken together with the drawings.

BRIEF DESCRIPTION OF THE FIGURES

The Figure is a schematic depiction of a marine vessel incorporating one example of architecture according to the present disclosure.

DETAILED DESCRIPTION

Figure 1:
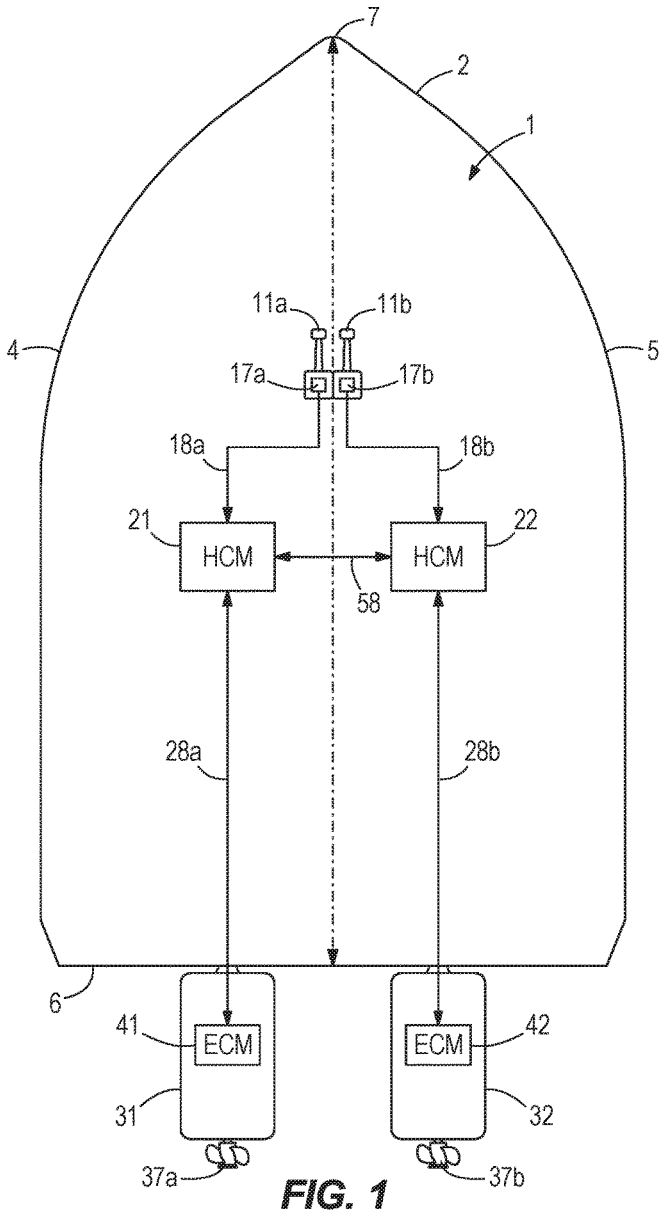
FIG. 1 presents one embodiment of a system for controlling propulsion of a marine vessel.

The present inventors have recognized that a potentially dangerous situation may occur in certain marine applications involving two or more marine drives, especially in marine racing applications or other high speed operations of marine vessels, where the power output of one marine drive is suddenly reduced due to a fault condition detected in that marine drive, such as a problem in the engine of the respective marine drive. The recognized situation may occur where a power limit restriction is placed on a marine drive by a control module, such as when a fault condition is detected somewhere in the marine drive or associated systems and the power output of the marine drive is reduced and limited in order to protect the marine drive from unnecessary damage. That power limit restriction, and the resulting reduction in output power by the restricted marine drive, causes differing power outputs from each marine drive on a marine vessel despite the operator requesting the same power from all engines. As discussed in more detail below, the sudden unbalanced output power can introduce undesired steering torques which, especially at high speed operations, may result in dangerous operating conditions for a drivers and passengers on the marine vessel and/or may cause damage to the marine vessel.

In light of the foregoing problems with and potential dangers caused with existing propulsion systems recognized by the inventors, the inventors developed the presently disclosed system and method for controlling propulsion of a marine vessel by two or more marine drives wherein, upon implementation of a power limit restriction on the first marine drive due to a fault condition, the power output of another marine drive in the system is also limited in order to balance the power output on either side of a vessel centerline to avoid any significant power imbalance and undesired steering torque. In one embodiment, a synchronizing power limit is placed on at least a second marine drive based on the power limit restriction on the first marine drive due to a fault condition, such that the power output of the first marine drive and the second marine drive is approximately equal. Once the power output of each of the marine drives is sufficiently reduced to be at or below the power limit restriction and/or the synchronizing power limit restriction, and thus the threat of an undesired and spontaneous power imbalance is avoided, the synchronizing power limit on the second marine drive may be removed. In a preferred embodiment described herein, the system requires a user to take affirmative action to remove the power limit restriction, such as reducing the power demand to at or below the power limit restriction by pulling back the remote control lever accordingly. At that point the operator will be aware of the potential power imbalance due to the power limit restriction on the first marine drive and will be able to compensate and operate the propulsion system accordingly.

As will be known to one of ordinary skill in the art, a power limit restriction is a limitation on the maximum power output of a marine drive and is generally implemented as a protection mechanism by an associated engine control module or helm control module upon detection of a fault condition. Such a fault condition may be a sensed value that is outside a predetermined acceptable range (e.g., engine pressure, engine temperature, battery voltage, oil pressure, oil level, engine speed, etc.), a faulty sensor, a faulty communication bus, or a faulty control module. The fault condition may be detected by an engine control module or a helm control module associated with the marine drive, and imposition of the power limit restriction may be initiated by either control module. Upon detection of a fault condition in the marine drive or in a system associated with the marine drive, the associated control module may determine the power limit restriction necessary to protect the engine and/or other parts of the faulty marine drive. For example, the power limit restriction may be a value between 0% and 100%, where 0% represents zero power output and 100% represents the maximum power output that the engine is capable of. Air flow to the engine of the marine drive is often used as a proxy for power output of the marine drive, such as intake airflow measured by the mass air flow sensor; but in other embodiments may be any other engine parameter for normalizing power output, such as torque. Thus, 0 grams per second air flow is determined to be 0% power output, and a predetermined maximum air flow (e.g., 1100 grams/second) is associated as being 100% power output. Such power calculations are known and disclosed in the relevant art, including in U.S. Pat. Nos. 6,298,824 and 6,701,890 incorporated by reference above, and also in U.S. Pat. No. 5,595,159 which is hereby incorporated by reference in its entirety. Accordingly, in one embodiment the power limit restriction is enacted as an air flow restriction, such as by controlling a throttle valve to provide the intake air flow corresponding with the power limit restriction percentage value.

Figure 2:
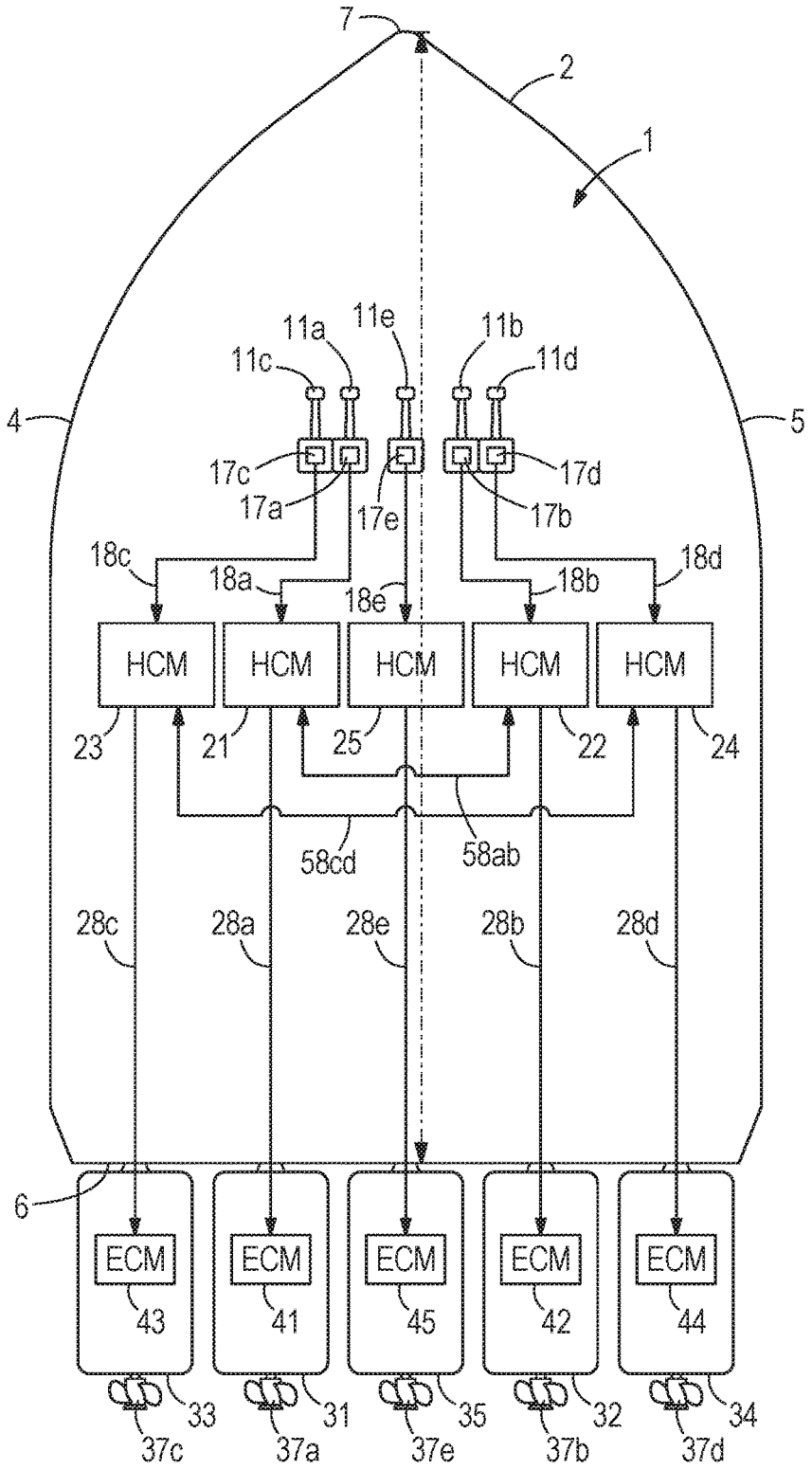
FIG. 2 provides another embodiment of a system for controlling propulsion of a marine vessel.

FIGS. 1 and 2 illustrate a marine vessel 2 having a system 1 for controlling propulsion in accordance with the present disclosure. The system 1 includes at least two marine drives (31 and 32 FIGS. 1 and 31-35 in FIG. 2), which in the depicted embodiments are outboard motors coupled to the transom 6 of the marine vessel 2. The marine drives 31-35 are attached to the marine vessel 2 in a conventional manner such that each is rotatable about a respective vertical steering axis in order to steer the marine vessel 2. In the examples shown and described, the marine drives 31 and 32 (and 31-35 in FIG. 2) are outboard motors; however, the concepts of the present disclosure are not limited for use with outboard motors and can be implemented with other types of marine drives, such as inboard motors, inboard/outboard motors, hybrid electric marine propulsion systems, pod drives, and/or the like.

In the examples shown and described, the marine drives have an engine that causes rotation of the drive shaft to thereby cause rotation of a propulsor shaft having a propulsor 37 at the end thereof, such as a propeller, impeller, or combination thereof. The propulsor 37 is connected to and rotates with the propulsor shaft propels the marine vessel 2. The direction of rotation of the propulsor 37 is changeable by a gear system, which has a forward gear associated with a forward thrust caused by first rotational direction and a reverse gear associated with a backward thrust caused by the opposite rotational direction. As is conventional, the gear system is positionable between the forward gear, a neutral state (no thrust output), and the reverse gear. Such positioning is controlled by a remote control 11 (FIGS. 1-3) associated with the respective marine drive 31-35. As is conventional, the remote control 11 includes a lever 50 movable by an operator into a reverse position at causes the gear system to shift into reverse gear, a neutral position that causes the gear system to shift into a neutral state, and a forward position that causes the gear system to shift into forward gear. The remote control lever 50 is also movable by an operator to provide control the throttle, and thus the thrust, within the respective gear.

Referring to FIG. 1, each marine drive 31, 32 is controlled by a respective helm control module (HCM) 21, 22, which is communicatively connected to an engine control module (ECM) 41, 42 for that respective marine drive 31, 32. The connection between the HCM 21, 22 and the ECM 31, 32 is via a communication link 28*a*, 28*b*, respectively, which in may be by any known means and in various embodiments could be a CAN bus for the marine vessel, a dedicated communication bus, or line, between the respective control modules 21 and 31, 22 and 32, or via a wireless communication protocol. Likewise, the first HCM 21 and the second HCM 22 are communicatively connected via communication link 58 so that information can be exchanged therebetween, which may also be by any known means including via the CAN bus for the marine vessel, a dedicated communication bus between the respective HCMs 21 and 22, or via a wireless communication protocol. In other embodiments, the methods and systems described herein may be accomplished by the ECMs 41 and 42 associated with the respective marine drives 31 and 32 without the involvement of HCMs or other additional control modules, and in such an embodiment the ECMs 41 and 42 may be connected by any wired or wireless communication link as described above. For example, the ECMs 41 and 42 may directly communicate their power limit status with one another, and may be equipped to execute methods to determine and implement a synchronizing power limit.

Each HCM 21, 22 is communicatively connected to a remote control 11*a*, 11*b* for controlling the operation of the respective marine drive 31, 32. In another embodiment, both marine drives 31 and 32 are controlled by a single remote control 11 communicatively connected to both HCMs 21, 22 such that the throttle request is the same for the two drives and the throttles are not separately controllable by an operator. In one preferred embodiment, the remote control 11 is a drive-by-wire input device, and the position of the lever 50 sensed by the position sensor 17 will be translated into a control input to a throttle valve, for example. Such drive-by-wire systems are known in the art, an example of which is disclosed at U.S. Pat. No. 9,103,287 incorporated herein.

Figure 3:
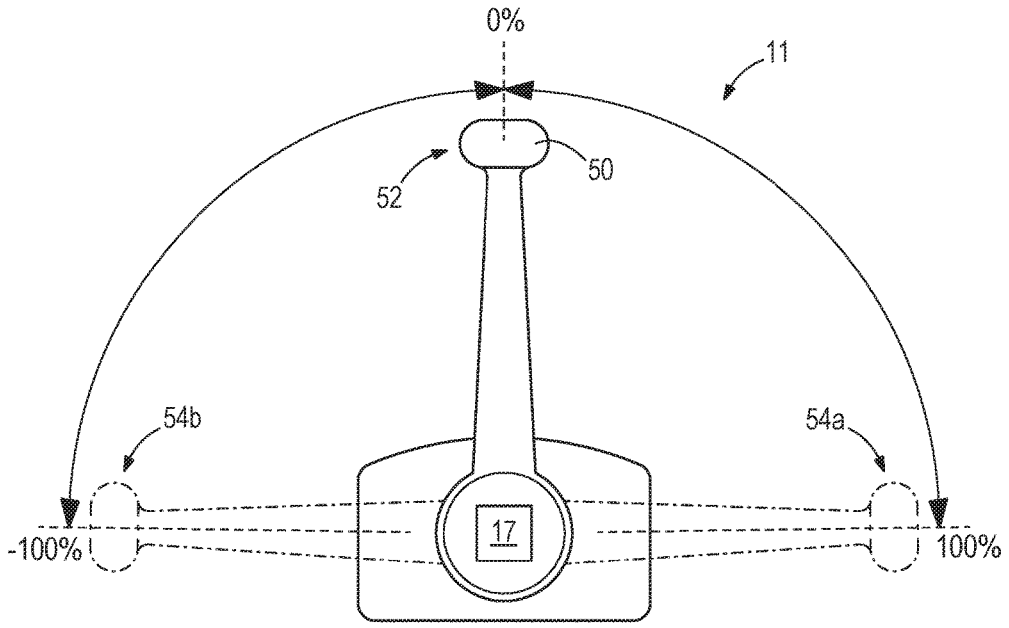
FIG. 3 provides one embodiment of a remote control for a system for controlling propulsion of a marine vessel.

As shown in FIG. 3, each remote control 11 has a lever 50 positionable between a neutral position 52 associated with engine idle and a neutral position of the gear system, and a full forward throttle position 54*a* and a full reverse throttle position 54*b*. The full throttle positions 54*a*, 54*b* are associated with maximum power output in the respective gear, and the positions therebetween representing the various throttle positions between 0% and 100% associated with a corresponding air flow (and thus power output) between 0% and 100%. The position of the lever 50 is determined by the position sensor 17 providing an analog output or a digital output of angular position to a respective helm control module 21, 22. The position of the lever 50 may be expressed as a percent of the range of motion of the lever 50 in the respective direction—i.e., between 0% and 100% in the forward position and between 0% and −100% in the reverse direction. Each lever position between 0% and 100% is determined by the respective HCM 21, 22 to provide a throttle control command to control the throttle valve to provide a corresponding power output. For instance, a handle position of 50% corresponds with throttle control to provide 50% power output. The lever position may be measured by the position sensor 17 or sampled by the respective helm control module 21, 22 (depending on whether the position sensor 17 is an analog or digital device) at a fixed sampling rate, which in an exemplary embodiment may be in the range of 5 Hz to 10 Hz. For example, the position sensor 17 may be a programmable magnetic encoder, a clinometer, a Hall Effect sensor, a potentiometer, a rotary encoder, or the like. To provide just one example, the position sensor 17 may be part number 881070 by Mercury Marine of Fond du Lac, Wis.

In presently available multi-drive systems, HCMs exchange limited information between one another to carry out certain programming instructions that may require coordination between the marine drives 31 and 32. However, current systems for controlling propulsion on marine drives do not account for sudden power imbalances caused by imposition of a power limit restriction on one marine drive within the system, and thus the dangerous conditions described above can arise. Accordingly, in the presently disclosed solution developed by the inventors, the HCMs 21 and 22 exchange information regarding their current power limits and each execute software instructions that prevent a sudden power output reduction by a single marine drive 31, 32. Specifically, in the event of detection of a fault condition relating to one of the marine drives 31, 32 and the imposition of a power limit restriction on that marine drive 31, 32, the helm control module 21, 22 associated with the faulted marine drive 31, 32 communicates the power limit restriction to the other, non-faulted HCM 21, 22. Each HCM 21, 22 executes software instructions that, upon receipt of notification of the power limit restriction from the other HCM 21, 22, imposes a synchronizing power limit to reduce the power output of the non-faulted marine drive 31, 32 and avoid a dangerous imbalance of power output on either side of the marine vessel.

In one embodiment, the synchronization software may execute instructions to determine a synchronizing power limit for the non-faulted marine drive based on a power limit restriction value communicated. For example, the HCM 21, 22 receiving notification of the power limit restriction may set a synchronizing power limit equal to the power limit restriction and immediately instruct its corresponding non-faulted marine drive 31, 32 to reduce power output down to the synchronizing power limit in a safe manner. For example, the power output instruction may be filtered to smooth the power reduction rate to assure that the marine vessel 2 is slowed down in a safe manner. In another embodiment, the synchronizing power limit may be a predefined percentage of the power limit restriction, which in certain preferred embodiments may be a percentage or preset value over 100% of the power limit restriction. For example, the synchronizing power limit may be determined as 125% of the power limit restriction, or in other embodiments may be calculated as some other amount over the power limit restriction on the faulted marine drive 31, 32. In such an embodiment, the reduction of the non-faulted marine drive 31, 32 to some value or amount over the power limit restriction may avoid a dangerous power imbalance while also allowing the operator to maintain more power output than in a situation where the synchronizing power limit is equal to the power limit restriction. Such an embodiment may be especially valuable in applications, such as racing, where maintaining as much power output as possible is desirable.

In a different embodiment, the synchronizing power limit may be set to a predetermined value, such as a maximum safe power output level under which it is determined that an imbalance in the power outputs between the marine drives 31 and 32 will not cause a dangerous situation. For instance, if it is determined for a particular marine vessel 2 that a power imbalance between the marine drives 31 and 32 will not be unsafe at power output values under 70% of the maximum power output and at corresponding speeds under 70% of the maximum speed for the marine vessel 2, then the synchronizing power limit may be set to 70%. In that situation, the power output of the marine drives 31 and 32 will be reduced approximately equally between 100% power output and 70% power output, at which point the marine drive 31, 32 with the synchronizing power limit would remain at 70% and the marine drive with the power limit restriction would continue to reduce its power output down to the power limit restriction value (assuming that the power limit restriction is less than the synchronizing power limit).

Once the marine drives 31 and 32 have been reduced to the respective power limit restriction and synchronizing power limit, it may be assumed that the potential hazard is eliminated. Accordingly, once the user has taken some affirmative action to acknowledge and remove the synchronizing power limit, maximum control may be returned back to the operator. However, the power limit restriction will remain so long as the fault condition remains. Thus, the user may need to compensate for the thrust imbalance once the non-faulted marine drive 31, 32 is returned to full power output, such as by providing steering compensation and/or reducing the power demanded of the non-faulted marine drive 31, 32 by the respective remote control 11*a*, 11*b*. In one embodiment, the synchronizing power limit on the non-faulted marine drive 31, 32 may be removed by the respective HCM 21, 22 once the non-faulted marine drive has reduced its power output down to the synchronizing power limit, and may also require that the output of the faulted marine drive 31, 32 reach the power limit restriction, and such information may be exchanged by the HCMs 21 and 22. Furthermore, the HCM 21, 22 associated with the non-faulted marine drive 31, 32 may further execute instructions requiring that the power demand associated with the remote control lever 50 position does not exceed the synchronizing power limit. For instance, if the synchronizing power limit is 70%, the lever 50 must reach a position equated with 70% or less before the synchronizing power limit is removed. In another embodiment, the HCM 21, 22 may be configured to require that the lever be moved to some predetermined position below the synchronizing power limit, such to the neutral position 52.

Accordingly, in the embodiment of FIG. 1 with only two marine drives 31, 32 the power output of both marine drives is reduced upon implementation of a power limit restriction on either one of the marine drives 31, 32. However, in an embodiment with more than two marine drives, the synchronizing power limit restriction may be employed on all of the marine drives, or may be employed on a subset of the marine drives as required to keep the thrust imparted on either side of the centerline 7 of the marine vessel 2 approximately equal so as to at least avoid such a substantial imbalance to cause a hazard. For example, each marine drive may be assigned a peer marine drive having an equal and opposite position with respect to the centerline 7.

In a boat having multiple marine drives, the marine drives are generally positioned symmetrically about a centerline 7 of the marine vessel 2 so that the forces on the marine vessel balance and no appreciable net torque on the marine vessel is created when the marine drives 31 and 32 are in the straight ahead position—i.e., when the force created by the propulsor 37*a*-37*e* for the marine drive 31-35 is in the straight ahead direction parallel with the centerline 7. Accordingly, a marine vessel 2 equipped with two marine drives 31 and 32 (FIG. 1) has the marine drives positioned equidistant from the centerline 7. Similarly, when additional marine drives are added to the system, they are positioned so that no net torque is provided when all marine drives are in the straight ahead position. Accordingly, a third marine drive added to the system would be added directly in the center marine vessel such that the force vector created by the propulsion of the third marine drive in a straight ahead position would be along the centerline 7. FIG. 2 illustrates this concept, having five marine drives 31-35 positioned symmetrically about the centerline 7. Specifically, the first marine drive 31 and the second marine drive 32 are positioned on the inner port side and inner starboard side, respectively, about the centerline 7. The third marine drive 33 and fourth marine drive 34 are positioned on the outer port side and outer starboard side, respectively, and equidistant from the centerline 7. The fifth marine drive 35 is positioned in the center along the transom 6 and in line with the centerline 7.

Similar to the system described above with respect to FIG. 1, the system depicted in FIG. 2 includes a helm control module 21-25 for each marine drive 31-35, which is communicatively connected via communication link 28*a*-28*e* to the engine control module 41-45 for each marine drive 31-35. Additionally, in the embodiment of FIG. 2, each marine drive 31-35 has an associated remote control 11*a*-11*e* having a position sensor 17*a*-17*e* as described above, such that the output power, or thrust, can be controlled by a user. Each remote control 11*a*-11*e* is connected to the HCM 21-25 for the respective marine drive 31-35 via communication link 18*a*-18*d*, which as described above, may be a CAN bus, a dedicated communication bus, or a wireless communication link.

In the embodiment of FIG. 2, the inner port marine drive 31 and the inner starboard marine drive 32 are assigned as peer marine drives, and the outer port marine drive 33 and out starboard marine drive 34 are assigned as peers. The center marine drive 35 does not have a peer because its thrust is along the centerline 7 and thus a power reduction by the center marine drive 35 would not cause a power imbalance. By execution of the control methods disclosed herein, imposition of a power limit restriction on any of the marine drives 31-34 in the starboard or port positions would lead to imposition of a synchronizing power limit on the peer marine drive. In other words, detection of a fault condition on either of the inner port or inner starboard marine drives 31, 32 would lead to the HCMs 21, 22 to coordinate power limits on and corresponding power reductions of both the peer marine drives 31, 32, but the outer port and outer starboard drives 33, 34 would maintain their full power output capabilities. Likewise, a fault condition detected on either of the outer port or outer starboard marine drives 33, 34 would lead to a power limit and corresponding power output reduction of both of the outer peer marine drives 33, 34, but would not change the power output of either of the inner marine drives 31, 32. The power output of the center marine drive 35 would not be affected by power limits placed on any of the other drives. Such an embodiment allows maintenance of maximum power output while also avoiding the unsafe conditions caused by the sudden imposition of a power limit restriction on a single marine drive 31-35 after detection of a fault condition on that marine drive.

The peer marine drives communicate with one another via a communication link, which is described above with respect to FIG. 1. More specifically, the inner HCMs 21, 22 communicate via communication link 58*ab* and the outer HCMs 23, 24 communicate via communication link 58*cd*. Each of these communication links 58*ab* and 58*cd* may be via the CAN bus for the marine vessel 2, and thus may be on the same physical communication bus, or may be embodied as dedicated and separate physical communication lines. Alternatively, the communications links 58*ab* and 58*cd* may enable respective peer HCMs 21 and 22, 23 and 24 to communicate the power limits via wireless protocols. Likewise, as described above, in embodiments where the power limit synchronization methods and systems are accomplished at the ECMS 41-45, the ECMs 41-45 may be connected by the respective communication links 58*ab* and 58*cd*, which again may be accomplished by any wired or wireless communication means.

In the embodiment of FIG. 2 where each marine drive 31-35 has a dedicated remote control 11*a*-11*e*, an imposed synchronizing power limit may be removed by a respective HCM 21-25 when the lever passes below a corresponding lever position associated with the synchronizing power limit, as is described above with respect to FIG. 1. In another embodiment, two or more marine drives may be paired and controlled simultaneously with a single remote control 11, and in such an embodiment, the power output of multiple marine drives, including those not limited by the synchronizing power limit, may need to be reduced in order to remove the synchronizing power limit on a particular marine drive.

Figure 4:
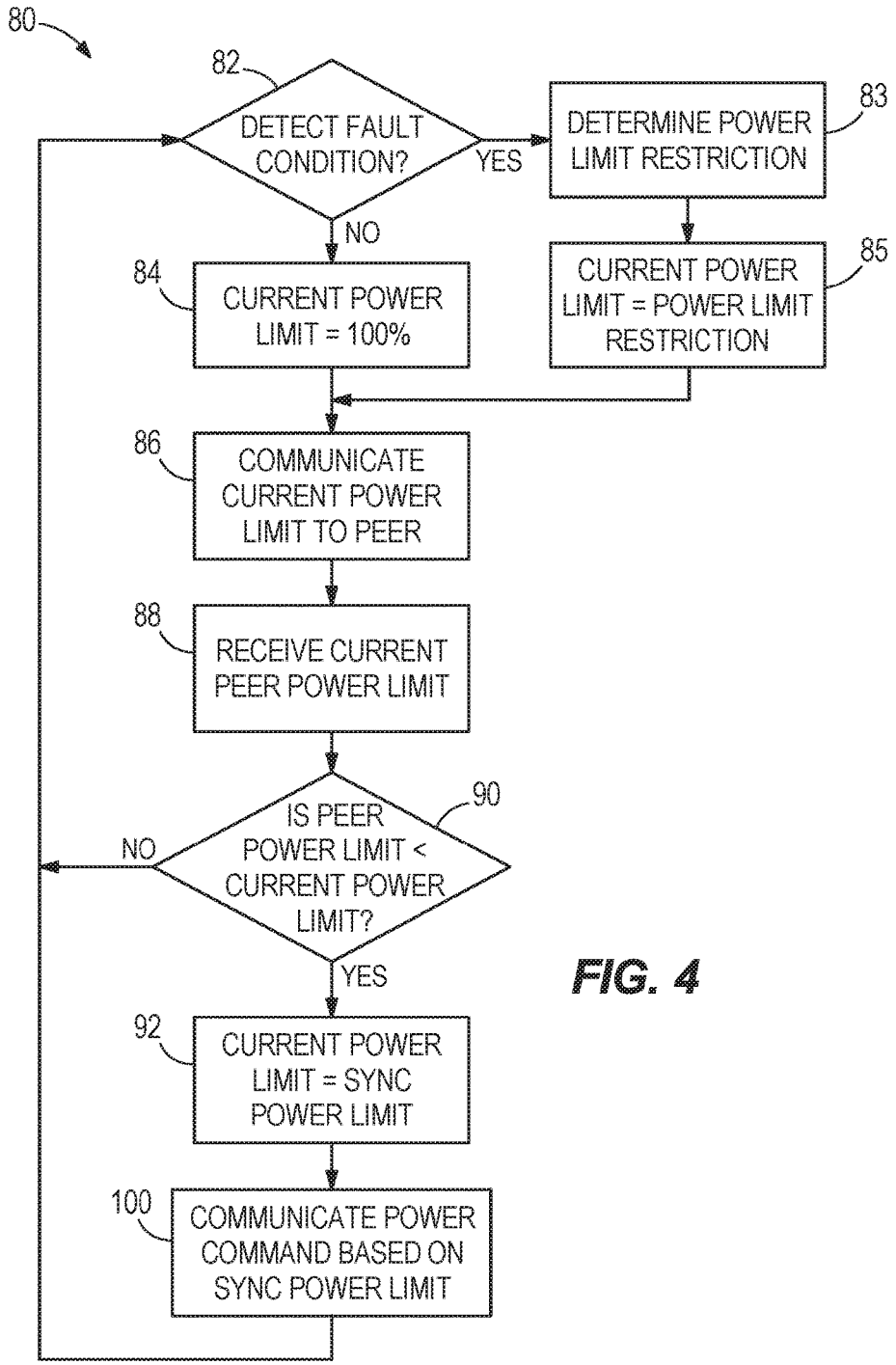
FIG. 4 provides one embodiment of a method for controlling propulsion of a marine vessel.

FIG. 4 depicts one embodiment of a method 80 of controlling propulsion of two or more marine drives on a marine vessel. If a fault condition is detected at step 82, such as by an ECM or HCM associated with a particular marine drive, then step 83 is executed to determine a power limit restriction based on that fault condition. The current power limit for the marine drive is set as the power limit restriction at step 85. On the other hand, if a fault condition is not detected at step 82, then the current power limit is set to 100% at step 84. Steps 82-85 may be executed by either or both of an ECM and an HCM associated with a particular marine drive, and the current power limit will be communicated between the two control modules as described above.

At step 86, the current power limit is communicated to a control module associated with a peer marine drive. Assuming that the peer marine drive has executed the same instructions, a current peer power limit is received at step 88 for the peer marine drive. At step 90, it is determined whether the peer power limit is less than the current power limit. If it is not, then the current power limit determination is completed and the system returns to step 82. If the peer power limit is less than the current power limit, then the current power limit is set to the synchronizing power limit at step 92. The synchronizing power limit may be determined in various ways as described herein. At step 100, a corresponding power reduction command based on the synchronized power limit is then communicated to reduce the power output of the marine drive. For example, the HCM may communicate an instruction to the ECM to reduce the power output of the corresponding marine drive, such as by changing the position of the throttle valve to reduce the intake air flow.

Figure 5:
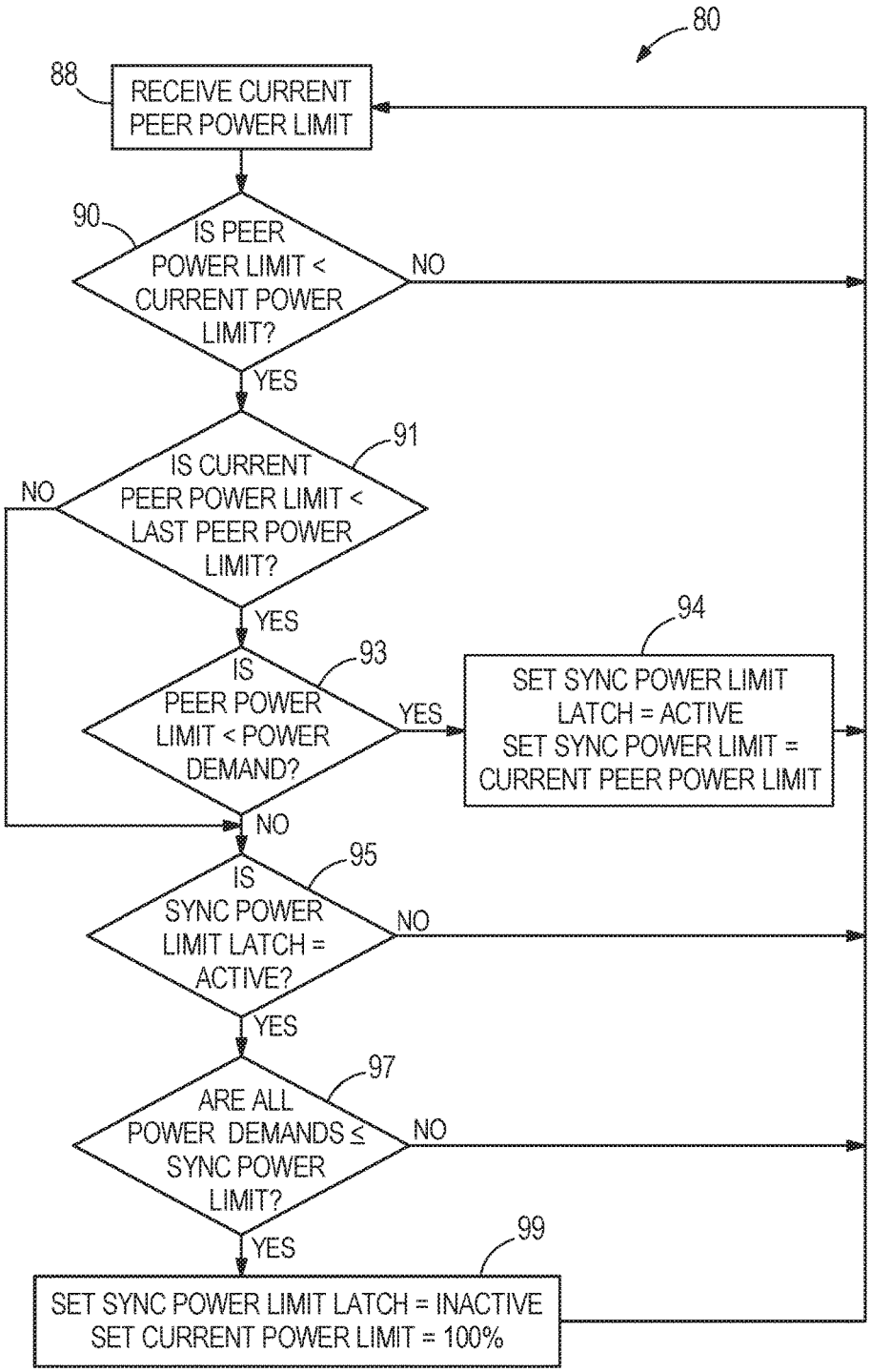
FIG. 5 provides another embodiment of a method for controlling propulsion of a marine vessel.

FIG. 5 depicts steps of another embodiment of a method for controlling propulsion of two or more marine drives, and specifically depicts steps executed, for example, by each HCM in the system 1 to determine a synchronizing power limit. A current peer power limit is received at step 88 and a comparison is made at step 90 to determine whether the peer power limit is less than the current power limit set for the associated marine drives, as is described above. At step 91, the HCM determines whether the current peer power limit is less than the last peer power limit stored. If so, then at step 93 it is determined whether the peer power limit is less than the current power demand, such as determined by the lever 50 position as described above. If so, then the synchronizing power limit is set to the peer power limit at step 94. Additionally at step 94, a synchronizing power limit latch is set to active. The power limit determination is then complete and the instruction set begins again.

Returning to step 91, if the current power limit is not less than the peer power limit, then it is determined at step 95 whether the synchronizing power limit latch is active. Thus, step 95 determines whether the synchronized power limit was set in a previous instruction cycle. If not, then the power limit determination is complete and the instruction set begins again. If at step 95 the synchronizing power limit latch is active, then step 97 is executed to determine whether all power demands are less than or equal to the synchronizing power limit. For example, it may determine whether all levers 50 of the remote controls 11 in the system 1 have reached a threshold lever position associated with a power output demand that is less than or equal to the synchronizing power limit. Other exemplary methods for determining whether the synchronizing power limit can be removed are also described herein, and may be alternatively employed at step 97. If step 97 is false, then the synchronizing power limit remains and the instruction set begins again. If the conditions of step 97 are true, or satisfied, then step 99 is executed to remove the power limit, including setting the synchronizing power limit latch to inactive and setting the current power limit equal to 100%.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method for controlling propulsion of two or more marine drives on a marine vessel, the method comprising:

detecting a fault condition relating to a first marine drive;

determining, at a first control module associated with the first marine drive, a power limit restriction for the first marine drive based on the fault condition;

communicating the power limit restriction with the first control module;

receiving the power limit restriction at a second control module associated with a second marine drive; and reducing the power output of the second marine drive based on the power limit restriction for the first marine drive.

2. The method of claim 1, further comprising controlling the second marine drive with the second control module to reduce the power output of the second marine to the power limit restriction.

3. The method of claim 1, further comprising:

receiving a lever position of a remote control manually operable to provide throttle control to the second marine drive;

determining at the second control module that a power demand associated with the lever position exceeds the power limit restriction;

determining at the second control module a synchronizing power limit based on the power limit restriction; and automatically controlling the second marine drive to reduce the power output of the second marine drive to the synchronizing power limit.

4. The method of claim 3, wherein the synchronizing power limit is equal to the power limit restriction.

5. The method of claim 3, wherein the synchronizing power limit is a predetermined value.

6. The method of claim 3, wherein the synchronizing power limit is a predetermined percentage over the power limit restriction.

7. The method of claim 3, further comprising:

receiving an updated lever position;

determining that a power demand associated with the updated lever position does not exceed the synchronizing power limit; and removing the synchronizing power limit.

8. The method of claim 3, further comprising:

receiving an updated lever position;

determining that a power demand associated with the updated lever position does not exceed a predetermined value; and removing the synchronizing power limit.

9. The method of claim 3, further comprising:

receiving an updated lever position;

determining that the updated lever position does not exceed a predetermined percentage of a full throttle position; and removing the synchronizing power limit.

10. The method of claim 1, further comprising controlling the second marine drive with the second control module to reduce the power output of the second marine drive to a predetermined value.

11. A system for controlling propulsion of a marine vessel, the system comprising:

a first marine drive;

a first control module associated with the first marine drive;

a second marine drive;

a second control module associated with the second marine drive; and wherein upon implementation of a power limit restriction on the first marine drive due to a fault condition, the second control module limits a maximum power output of the second marine drive.

12. The system of claim 11, having a first engine control module associated with the first marine drive and a first helm control module communicatively connected to the first engine control module;

a second engine control module associated with the second marine drive and a second helm control module communicatively connected to the second engine control module;

wherein upon implementation of the power limit restriction on the first marine drive, the first helm control module communicates the power limit restriction to the second helm control module, and the second helm control module determines a synchronizing power limit based on the power limit restriction.

13. The system of claim 12, wherein the synchronizing power limit is equal to the power limit restriction.

14. The system of claim 12, wherein the synchronizing power limit is a predetermined value.

15. The system of claim 12, further comprising:

a first remote control having a first lever manually operable to provide throttle control to the first marine drive and having a first position sensor to sense a first lever position of the first lever and communicate the first lever position to the first helm control module;

a second remote control having a second lever manually operable to provide throttle control to the second marine drive and having a second position sensor to sense a second lever position of the second lever and communicate the second lever position to the second helm control module;

wherein the synchronizing power limit restriction on the second marine drive is removed when the second helm control module determines that the second lever position reaches a threshold lever position.

16. The system of claim 15, wherein the synchronized power limit is a percentage value of the maximum power output of the second marine drive, and the threshold lever position is the position associated with the synchronized power limit.

17. The system of claim 16, wherein the threshold lever position is a neutral position.

18. A system for controlling propulsion of a marine vessel, the system comprising:

at least two marine drives, each marine drive having an engine control module;

at least two helm control modules, each helm control module associated with a respective one of the at least two marine drives and its engine control module; and wherein upon implementation of a power limit restriction on one of the at least two marine drives due to a detected fault condition, the maximum power output of at least another one of the at least two marine drives is also limited.

19. The system of claim 18, wherein each of the at least two marine drives is assigned a peer marine drive, and wherein the helm control module for the faulted marine drive communicates the power limit restriction to the helm control module for its peer marine drive, and the helm control module for the peer marine drive determines a synchronizing power limit and communicates the synchronizing power limit to the engine control module for the peer marine drive.

20. The system of claim 18, wherein the maximum power output of all of the at least two marine drives is limited to the power limit restriction.

* * * * *